US010322868B2

(12) United States Patent
Cupples et al.

(10) Patent No.: US 10,322,868 B2
(45) Date of Patent: Jun. 18, 2019

(54) CABLE ASSEMBLY DISPENSER SYSTEMS AND ASSOCIATED METHODS

(71) Applicants: Kenneth A. Cupples, Pawcatuck, CT (US); Adam Murano, San Marcos, CA (US)

(72) Inventors: Kenneth A. Cupples, Pawcatuck, CT (US); Adam Murano, San Marcos, CA (US)

(73) Assignee: Ortronics, Inc., New London, CT (US)

( * ) Notice: Subject to any disclaimer, the term of this patent is extended or adjusted under 35 U.S.C. 154(b) by 605 days.

(21) Appl. No.: 14/210,731

(22) Filed: Mar. 14, 2014

(65) Prior Publication Data

US 2014/0263814 A1 Sep. 18, 2014

Related U.S. Application Data

(60) Provisional application No. 61/793,395, filed on Mar. 15, 2013.

(51) Int. Cl.
*B65H 49/32* (2006.01)
*B65D 85/04* (2006.01)

(52) U.S. Cl.
CPC ..... *B65D 85/04* (2013.01); *B65H 49/322* (2013.01)

(58) Field of Classification Search
CPC ..... B65H 49/322; B65H 49/328; B65D 85/04
USPC ..... 242/588.3–588.4; 221/279
See application file for complete search history.

(56) References Cited

U.S. PATENT DOCUMENTS 2,182,446 A 12/1939 Nelson
2,237,920 A * 4/1941 Armitt ..... B65D 83/0805 242/588.4
2,987,690 A 6/1961 Marbais
3,443,683 A * 5/1969 Rosengren ..... H01R 24/40 206/225
4,043,485 A * 8/1977 Tippetts ..... H05K 13/0084 206/499
4,249,672 A * 2/1981 Rossi ..... B65G 59/067 221/264
4,258,834 A 3/1981 Hawley et al.
D283,221 S 4/1986 West
4,702,551 A * 10/1987 Coulombe ..... G02B 6/4454 385/135

(Continued)

OTHER PUBLICATIONS

ProFlex Package, REELEX Packaging Solutions, Inc., Patterson, NY, USA, available at http://www.reelex.com/Literature/Product%20Sheets/Packaging%20Info%20Sheets/ProFlex%20Package.pdf.

(Continued)

*Primary Examiner* — Michael Collins
(74) *Attorney, Agent, or Firm* — McCarter & English, LLP

(57) ABSTRACT

Exemplary embodiments are directed to cable dispenser systems that generally include at least two cable assemblies. The cable assemblies includes at least one cable that includes an elongated cord. The cable assemblies include a support element configured and dimensioned to support the at least one cable thereon. The systems include a housing configured and dimensioned to receive the cable assemblies. The housing includes at least one opening for dispensing each of the cable assemblies. Dispensing a first cable assembly from the opening repositions a second cable assembly adjacent to the opening. Exemplary embodiments are also directed to methods of cable assembly dispensing.

14 Claims, 2 Drawing Sheets

(56) References Cited

U.S. PATENT DOCUMENTS 4,779,759 A * 10/1988 Seavey ..... B65D 83/00 221/154
4,846,343 A * 7/1989 Rupert ..... B65D 85/04 206/303
5,120,263 A * 6/1992 Ierfino ..... A63H 37/00 273/459
5,152,395 A * 10/1992 Cross ..... B65D 85/04 206/389
5,178,257 A * 1/1993 Cross ..... B65D 85/04 198/465.1
5,421,501 A 6/1995 Haines
5,435,459 A * 7/1995 Huck ..... B65D 83/04 206/440
5,447,253 A * 9/1995 Williams ..... A61F 6/005 220/526
5,544,273 A * 8/1996 Harrison ..... G02B 6/4453 385/134
5,562,328 A * 10/1996 Schottenfeld ..... A61F 6/005 221/100
5,701,981 A * 12/1997 Marshall ..... H02G 11/02 191/12.4
5,732,445 A 3/1998 Stodolka et al.
5,892,177 A 4/1999 Mazaris
D434,002 S 11/2000 Rossman et al.
6,198,046 B1 3/2001 Moodie
D445,766 S 7/2001 Solomon
6,309,239 B1 10/2001 Johnston
6,353,181 B1 3/2002 Jarry et al.
6,428,348 B1 8/2002 Bean
6,491,186 B1 * 12/2002 Wiggins ..... B42F 7/14 206/39.4
6,503,097 B2 1/2003 Archambault
6,538,205 B2 3/2003 Ueno
6,567,277 B1 5/2003 Doherty et al.
6,699,060 B1 3/2004 Scott
6,746,272 B2 6/2004 Bean
D495,999 S 9/2004 Lewis
6,905,374 B2 6/2005 Milan
6,979,221 B1 12/2005 Hunter
7,123,716 B2 10/2006 Jozitis et al.
7,172,456 B1 2/2007 Nagy
7,182,624 B1 2/2007 Miller
7,186,151 B2 3/2007 Komiyama
7,230,181 B2 6/2007 Simmons et al.
7,293,895 B2 11/2007 Grossman et al.
7,393,242 B1 7/2008 Saje
7,407,405 B1 8/2008 Slenczka
7,442,067 B1 10/2008 Amaral
7,465,182 B1 12/2008 McDonald
7,607,618 B2 10/2009 Mori et al.
7,815,025 B2 10/2010 Chen et al.
7,887,360 B2 2/2011 Andrade
8,011,950 B2 9/2011 Patel et al.
8,203,077 B2 6/2012 Honeycutt et al.
8,267,706 B2 9/2012 McGrath et al.
8,348,685 B2 1/2013 Liao et al.
8,348,695 B2 1/2013 Puzio et al.
8,353,719 B2 1/2013 Watts
8,399,769 B2 3/2013 Doll
8,447,062 B2 5/2013 Lin
8,535,082 B2 9/2013 Lifson
8,615,849 B2 12/2013 Rothbaum et al.
8,802,991 B1 8/2014 Hua et al.
9,173,710 B2 * 11/2015 Van Zuylen ..... A61B 50/30
9,216,848 B1 * 12/2015 Trinko ..... B65D 63/00
2004/0166718 A1 8/2004 Yoest
2007/0280599 A1 12/2007 Faika et al.
2008/0256761 A1 10/2008 Bukoski
2009/0064465 A1 3/2009 Andrade
2009/0321468 A1 * 12/2009 Enriquez ..... A61B 17/06114 221/1
2010/0006692 A1 * 1/2010 Galgano ..... B62B 1/14 242/588.4
2010/0025421 A1 * 2/2010 Volker ..... A61B 17/06114 221/46
2010/0184323 A1 7/2010 Patel et al.
2010/0210142 A1 8/2010 McGrath et al.
2011/0039446 A1 2/2011 Maass
2011/0084160 A1 * 4/2011 Therrell ..... B65H 49/322 242/588.3
2011/0189890 A1 8/2011 Lee et al.
2014/0263814 A1 * 9/2014 Cupples ..... B65D 85/04 242/588.3
2014/0263815 A1 * 9/2014 LaFontaine ..... B65H 49/322 242/594.5

OTHER PUBLICATIONS

PCT International Search Report and PCT Written Opinion from PCT/US2013/049869 dated Dec. 17, 2013.
PCT International Search Report and PCT Written Opinion from PCT/US2013/061922 dated Feb. 28, 2014.
PCT International Search Report and PCT Written Opinion from PCT/US2014/025309 dated Jul. 8, 2014.
U.S. Appl. No. 13/399,371, filed Feb. 17, 2012, 2013-0115808 A1.
U.S. Appl. No. 13/630,485, filed Sep. 28, 2012, 2013-0115806 A1.
U.S. Appl. No. 13/838,740, filed Mar. 15, 2013, 2013-0210264 A1.
U.S. Appl. No. 14/210,665, filed Mar. 14, 2014, 2014-0263815 A1.
PCT/US2013/049869, Jul. 10, 2013, WO 2015/005916.
PCT/US2013/061922, Sep. 26, 2013, WO 2014/052591.
PCT/US2014/025309, Mar. 13, 2014, WO 2014/151259.

* cited by examiner

CABLE ASSEMBLY DISPENSER SYSTEMS AND ASSOCIATED METHODS

CROSS-REFERENCE TO RELATED APPLICATIONS

The present application claims priority to a U.S. provisional patent application entitled "Cable Assembly Delivery System and Associated Methods," filed with the U.S. Patent and Trademark Office on Mar. 15, 2013, and assigned Ser. No. 61/793,395. The entire content of the foregoing provisional patent application is incorporated herein by reference.

TECHNICAL FIELD

The present disclosure relates to cable assembly dispenser systems and methods and, in particular, to cable assembly dispenser systems for efficient packaging and payout of cables.

BACKGROUND

Cables, e.g., patch cords, Category 5, Category 6, Category 6A, fiber optic cables, cables with plug and/or jack connectors, and the like, are generally used in a variety of settings to create electrical connections for communication between electronic devices, e.g., networking between switches, servers, data storage devices, and the like. In packaging/supplying cables to the trade, manufacturers generally package cables individually, e.g., in plastic packaging. Cables are generally also grouped together in large boxes when shipped from the manufacturer and can contain a variety of cables in each box. In addition, the site preparation prior to installation of cables generally requires an inventory of necessary cables to be allocated, the cables to be sorted, removed from their unit packaging, unbundled, and finally uncoiled in order to make the connection. Thus, large amounts of material are typically wasted in packaging cables and a large amount of time can be spent in identifying specific cable types when multiple cable types are implemented during the installation, thereby slowing the installation process and generally inconveniencing the installer. In an industry where large numbers of different cables may be required for installation at one time, individually removing each cable from the packaging and identifying whether the correct cable has been selected can lead to lengthy installation times.

Thus, a need exists for cable assembly dispenser systems that facilitate cost effective packaging and/or efficient cable access and installation in the field. These and other needs are addressed by the cable assembly dispenser systems and associated methods of the present disclosure.

SUMMARY

In accordance with embodiments of the present disclosure, exemplary cable assembly delivery systems are provided that generally include at least one cable, a support element and a coupler element. The at least one cable generally includes an elongated cord and, optionally, a first connector mounted with respect to one end of the elongated cord. The support element can be configured and dimensioned to support the at least one cable thereon. The coupler element can detachably secure the at least one cable to the support element.

The at least one cable generally includes a second connector mounted with respect to an end of the elongated cord opposing the first connector. The first and second connector can be, e.g., a plug, a jack, and the like. In some embodiments, rather than including a second connector, the at least one cable includes a bare cable end at an end of the elongated cord opposing the first connector. In some embodiments, rather than including first and second connectors, the at least one cable can include first and second bare ends on opposing ends of the elongated cord. The support element can be fabricated from, e.g., a cardboard material, a plastic material, and the like. In some embodiments, the support element can be collapsible. Further, the support element can define, e.g., a planar surface, a stiff surface, combinations thereof, and the like. The coupler element can be one or more of, e.g., a wrapping, a cable tie, adhesive tape, a spring-loaded clip or clamp, and the like.

In accordance with embodiments of the present disclosure, exemplary methods of cable assembly delivery are provided that generally include providing at least one cable that includes an elongated cord and, optionally, a first connector mounted with respect to one end of the elongated cord. The methods generally include providing a support element configured and dimensioned to support the at least one cable thereon. The methods further include detachably securing the at least one cable to the support element with a coupler element.

In accordance with embodiments of the present disclosure, exemplary cable assembly dispenser systems are provided that generally include at least two cable assemblies. Each of the at least two cable assemblies generally includes a least one cable that includes an elongated cord. In some embodiments, each of the at least two cable assemblies includes at least one connector mounted with respect to the elongated cord. In some embodiments, each of the at least two cable assemblies includes at least one bare end at an end of the elongated cord. Each of the at least two cable assemblies also includes a support element configured and dimensioned to support the at least one cable thereon. The support element defines, e.g., a planar surface, a stiff surface, and the like. Each of the at least two cable assemblies further includes a coupler element for detachably securing the at least one cable to the support element.

The systems generally include a housing configured and dimensioned to receive the at least two cable assemblies, e.g., in a stacked configuration. The stacked configuration can be a vertically stacked configuration and/or a horizontally stacked configuration. The housing includes at least one opening for dispensing each of the at least two cable assemblies. In general, dispensing a first cable assembly of the at least two cable assemblies from the at least one opening repositions, e.g., automatically, manually, combinations thereof, and the like, a second cable assembly of the at least two cable assemblies adjacent to the at least one opening.

In some embodiments, the systems include a mechanism, e.g., a spring-loaded mechanism, for repositioning the second cable assembly of the at least two cable assemblies adjacent to the at least one opening. The mechanism can impart and maintain a force on the second cable assembly in a direction of a position aligned with the at least one opening. In some embodiments, the mechanism automatically repositions the second cable assembly of the at least two cable assemblies adjacent to the at least one opening. In some embodiments, the mechanism is actuated manually to reposition the second cable assembly of the at least two cable assemblies adjacent to the at least one opening. In some embodiments, rather than or in combination with the spring mechanism, removing one cable assembly from the opening can automatically reposition the second or subsequent cable assembly adjacent to the opening due to gravity.

In some embodiments, the systems include a mechanism, e.g., a spring-loaded mechanism, for at least partially dispensing the first cable assembly of the at least two cable assemblies from the at least one opening when the first cable assembly is positioned in a position aligned with the at least one opening. The mechanism imparts a force in a direction of the at least one opening. In some embodiments, the systems include a counter positioned on the housing for sensing and indicating a number of cable assemblies remaining in the housing.

In accordance with embodiments of the present disclosure, exemplary methods of cable assembly dispensing are provided that generally include providing at least two cable assemblies. Each of the at least two cable assemblies includes at least one cable that includes an elongated cord. Each of the at least two cable assemblies further includes a support element configured and dimensioned to support the at least one cable thereon. The methods include providing a housing configured and dimensioned to receive the at least two cable assemblies, e.g., in a stacked configuration. The housing includes at least one opening for dispensing each of the at least two cable assemblies. The methods include dispensing a first cable assembly of the at least two cable assemblies from the at least one opening of the housing. The methods further include repositioning, e.g., automatically, manually, and the like, a second cable assembly of the at least two cable assemblies adjacent to the at least one opening.

In some embodiments, repositioning the second cable assembly of the at least two cable assemblies adjacent to the at least one opening includes imparting a force with a mechanism, e.g., a spring-loaded mechanism, on the second cable assembly in a direction of a position aligned with the at least one opening. In some embodiments, repositioning the second cable assembly of the at least two cable assemblies adjacent to the at least one opening includes imparting a force, e.g., a gravitation force, separate from or in combination with a force imparted by the mechanism. In some embodiments, dispensing the first cable assembly of the at least two cable assemblies from the at least one opening includes imparting a force with a mechanism, e.g., a spring-loaded mechanism, on the first cable assembly in a direction of the at least one opening to at least partially dispense the first cable assembly from the at least one opening.

In accordance with embodiments of the present disclosure, exemplary cable assembly dispensing systems are provided that generally include at least two cable assemblies. Each of the at least two cable assemblies includes an elongated cord. The systems generally include a housing configured and dimensioned to receive the at least two cable assemblies, e.g., in a stacked configuration. The housing includes at least one opening for dispensing each of the at least two cable assemblies. Dispensing a first cable assembly of the at least two cable assemblies from the at least one opening of the housing repositions, e.g., automatically, manually, and the like, a second cable assembly of the at least two cable assemblies adjacent to the at least one opening.

Each of the at least two cable assemblies can include a binding element for binding the elongated cord relative to itself and/or the first connector. Each of the at least two cable assemblies can include a support element configured and dimensioned to support one of the at least two cable assemblies thereon. The system generally includes a coupler element for detachably coupling one of the at least two cable assemblies to the support element.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed cable dispensers and associated systems and methods, reference is made to the accompanying figures, wherein.

DESCRIPTION OF EXEMPLARY EMBODIMENT(S)

Figure 1:
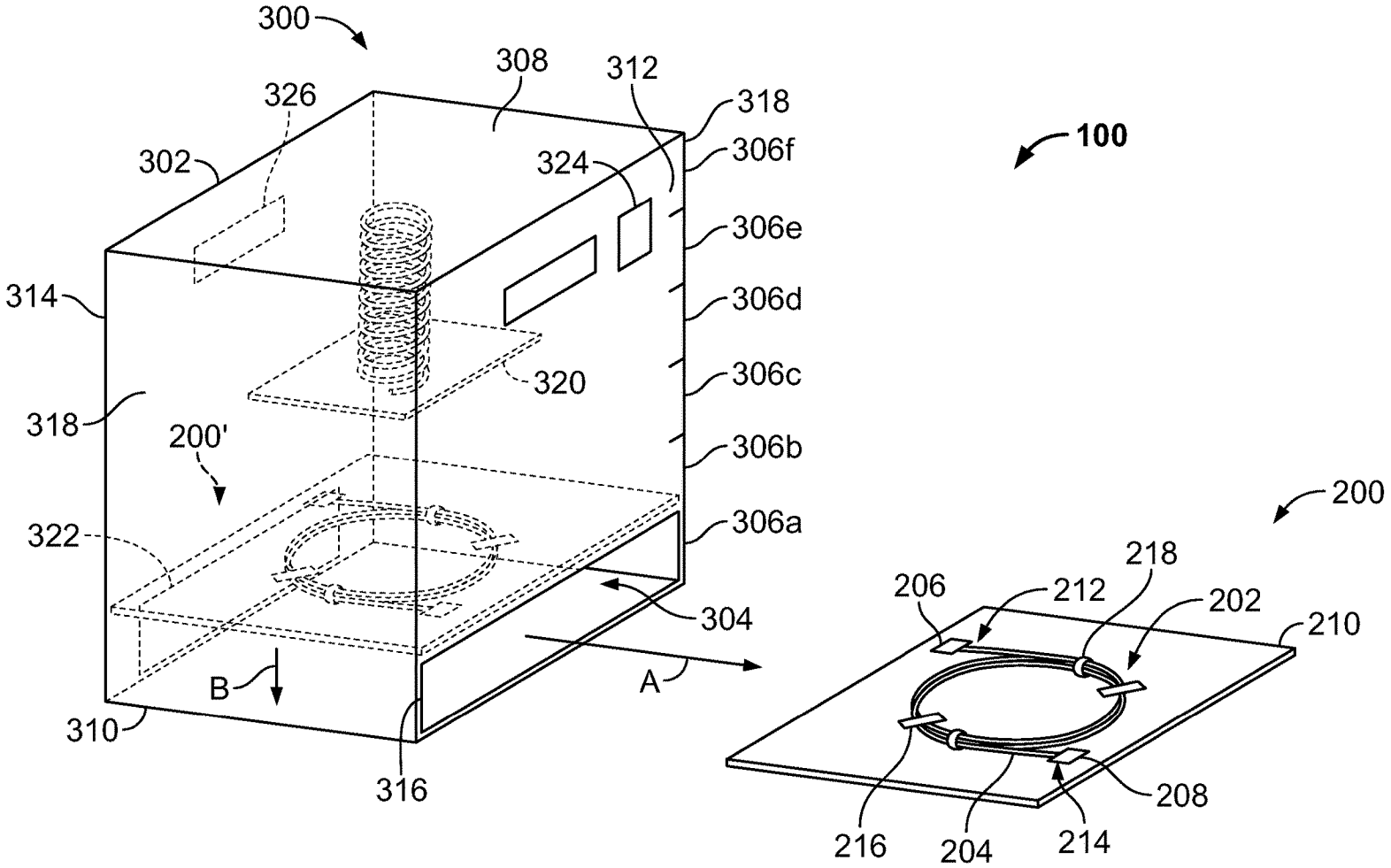
FIG. 1 is a perspective view of an exemplary cable assembly dispensing system, including an exemplary cable assembly and a cable assembly dispenser according to the present disclosure.

With reference to FIG. 1, a perspective view of an exemplary cable assembly dispensing system 100 (hereinafter "system 100"), e.g., a cable assembly packaging and payout system, is provided that includes an exemplary cable assembly 200 and a cable assembly dispenser 300. The cable assembly 200 generally includes at least one cable 202. In some embodiments, the cable assembly 200 can include multiple cables 202 secured relative to each other with coupler elements, e.g., clips, tape, cable ties, and the like. The cable 202 includes an elongated cord 204 which defines two opposing ends, e.g., a first end 212 and a second end 214. At least one of the first end 212 and second end 214 includes a connector 206, 208 mounted to the elongated cord 202. The connector 206, 208 can be, e.g., a plug, a jack, and the like. The plug can be, e.g., an RJ 45 type plug, a Category 5 plug, a Category 6 plug, a Category 6A plug, a fiber optic plug, and the like. In some embodiments, at least one of the first end 212 and the second end 214 defines a bare cable end, e.g., without the connectors 206, 208. In some embodiments, both the first and second ends 212, 214 define a bare cable end.

The cable assembly 200 can include a support element 210, e.g., a cardboard support element, a plastic support element, and the like. The support element 210 can be configured and dimensioned to support the cable 202 thereon. In particular, the support element 210 can be configured as, e.g., rectangular, square, circular, oval, and the like, as long as the support element 210 completely supports the cable assembly 202 thereon. In some embodiments, the support element 210 can define a substantially planar surface. In other embodiments, the support element 210 can define a curved surface. For example, the support element 210 can define a central groove configured and dimensioned to receive therein the cable 202 to ensure that the cable 202 does not fall off the support element 210. In some embodiments, the support element 210 can include side walls for housing the cable 202 to ensure that the cable 202 does not fall off the support element 210.

At least one coupler element 216, e.g., a wrapping, a cable tie, adhesive tape, a spring-loaded clip or clamp, and the like, can be used to detachably secure the cable 202 to the support element 210. The wrapping can be a plastic wrapping. In some embodiments, the wrapping can be transparent. In embodiments implementing a cable tie, the support element 210 can include one or more holes passing the thickness of the support element 210 to allow passage of the cable tie therethrough for detachably securing the cable 202 to the support element 210.

With reference to FIG. 1, the cable 202 is shown detachably secured to the support element 210 with an adhesive tape coupler element 216. In some embodiments, a binding element 218, e.g., a wrapping, a cable tie, adhesive tape, and the like, can be used to bind the elongated cord 204 of the cable 202 relative to itself and/or the connectors 206, 208. In particular, the cable 202 can be wound or coiled into, e.g., a circular configuration, an oval configuration, and the like, and a binding element 218 can be used to maintain the cable 202 in the wound configuration. In some embodiments, the cable 202 can be wound or coiled into, e.g., a circular configuration, an oval configuration, and the like, and the coupler element 216 can be used to detachably secure the cable 202 to the support element 210 and maintain the cable 202 in the wound configuration without the use of a binding element 218. It should be understood that alternative configurations of winding or coiling the cable 202 are within the scope of the present disclosure.

Packaging the cable assemblies 200 with only the support element 210, a coupler element 216 and, optionally, a binding element 218, can decrease costs associated with production of the cable assemblies 200 and reduce installation times by necessitating less materials to be removed for installation of the cable 202. For example, once dispensed from the dispenser 300, the cable assembly 200 can be unwound or uncoiled by removing the coupler element 216 and, optionally, tearing or breaking the binding element 218. Thus, rather than removing cables 202 from multiple packaging materials, the cable 202 can be ready for installation within a shorter period of time by necessitating a lesser amount of materials to be removed to unwind the cable 202.

Still with reference to FIG. 1, the system 100 generally includes a cable assembly dispenser 300 (hereinafter "dispenser 300"). The dispenser 300 includes a housing 302 which can be defined by a top wall 308, a bottom wall 310, a rear wall 314, a front wall 312 and side walls 318. In some embodiments, the housing 302 can be configured as, e.g., a cylindrical housing, a rectangular housing, and the like, depending on the configuration of the support element 210. In some embodiments, the housing 302 can include a handle 326, e.g., one or more openings configured and dimensioned to receive a user's fingers, a strap, and the like, for lifting or moving the system 100. The housing 302 defines an interior space 304 configured and dimensioned to receive a plurality of cable assemblies 200. In particular, the top wall 308 of the housing 302 can include a lid which can be opened to insert the plurality of cable assemblies 200 into the housing 302. The housing 302 can receive the cable assemblies 200 in a stacked configuration, e.g., vertically stacked in a top wall 308 to bottom wall 310 direction. In particular, the cable assemblies 200 can be stacked one on top of another until the top wall 308 is reached. For example, as shown in FIG. 1, the dispenser 300 can accommodate up to six cable assemblies 200 in first, second, third, fourth, fifth and sixth positions 306*a*-306*f*, respectively. However, it should be understood that in some embodiments, the dispenser 300 can accommodate any number of cable assemblies 200. In some embodiments, the housing 302 can be flipped on one of the side surfaces 318 or can be oriented such that the cable assemblies 200 are horizontally stacked in a direction perpendicular to the direction of dispensing.

The housing 302 includes at least one opening 316, e.g., an exit slot, for dispensing each of the cable assemblies 200 individually from the interior space 304. In particular, the opening 316 can be located near the bottom wall 310 of the housing 302 and can be substantially aligned with the first position 306*a* for a cable assembly 200. The opening 316 can be configured and dimensioned to allow the passage of one cable assembly 200 at a time when the cable assembly 200 positioned in position 306*a* is pulled out of the housing 316 in the direction A as shown in FIG. 1.

When a cable assembly 200 positioned in the first position 306*a* inside the housing 302 is dispensed and/or pulled out of the opening 316, a cable assembly 200' positioned immediately above the dispensed cable assembly 200 in the second position 306*b* can be automatically repositioned into the first position 306*a* adjacent to the opening 316. In particular, when a cable assembly 200 positioned in the first position 306*a* inside the housing 302 is dispensed and/or pulled out of the housing 302, all of the cable assemblies 200 positioned above the cable assembly 200 recently dispensed automatically move down one position in a direction B within the housing 302. For example, with reference to FIG. 1, when cable assembly 200 is pulled out of the opening 316 in the housing 302 as shown, cable assembly 200', which was positioned immediately above cable assembly 200, can move down to the first position 306*a* in the direction B.

In some embodiments, the dispenser 300 can include a spring-loaded mechanism 320, e.g., a spring-loaded surface, secured to the interior surface of the top wall 308. The mechanism 320 can impart a force in the direction B, e.g., in the direction of the bottom wall 310, on the cable assemblies 200 located within the housing 302. Thus, when a cable assembly 200 positioned in the first position 306*a* inside the housing 302 is dispensed and/or pulled out of the opening 316 in the housing 302, the mechanism 320 can impart a force onto the cable assemblies 200 remaining in the housing 302 to force and/or aid the movement of the cable assemblies 200 in the direction B such that the subsequent cable assembly 200 is positioned in the first position 306*a* and ready for dispensing. Although illustrated above the cable assembly 200' for clarity, it should be understood that the mechanism 320 can be positioned against and provide a force to the top cable assembly 200 in the stack of cable assemblies 200 within the dispenser 300.

In some embodiments, rather than automatically moving the subsequent cable assembly 200 from the second position 306*b* to the first position 306*a* when the cable assembly 200 has been dispensed from the first position 306*a*, the mechanism 320 can be manually actuated by a user with, e.g., a switch, to force the subsequent cable assembly 200 in the B direction. In some embodiments, rather than a using a mechanism 320, the cable assemblies 200 remaining in the housing 302 can be moved in the direction B by gravitational forces due to the weight of the stacked cable assemblies 200.

In some embodiments, the dispenser 300 can include an alternative spring-loaded mechanism 322, e.g., a spring-loaded surface. The mechanism 322 can be secured to the rear wall 314 of the dispenser and can impart a force in the direction A, e.g., in the direction of the opening 316, on the cable assembly 200 positioned in the first position 306*a*. Thus, when a cable assembly 200 is moved down from the second position 306*b* to the first position 306*a* inside the housing 302, the mechanism 322 can automatically force and/or aid in at least partially dispensing the cable assembly 200 out of the opening 316. In some embodiments, rather than automatically dispending the cable assembly 200 out of the opening 316, the mechanism 322 can be manually actuated by a user with, e.g., a switch, to at least partially dispense the cable assembly 200 out of the opening 316. Once the cable assembly 200 has been partially dispensed from the opening 316, the mechanism 322 can automatically reset to a position adjacent to the rear wall 314 to permit the subsequent cable assembly 200 to be moved down into the first position 306*a*.

In some embodiments, rather than positioning and/or dispensing only one cable assembly 200 at a time, the dispenser 300 can include, e.g., a switch, to allow selection of the number of cable assemblies 200 to be positioned in the first position 306*a* or to be dispensed from the opening 316. For example, the first position 306*a* and the opening 316 can be dimensioned to receive one or more cable assemblies 200 at one time. Thus, if a user requires more than one cable assembly 200 for installation, rather than dispensing each cable assembly 200 individually, several cable assemblies 200 can be dispensed at one time.

When a portion or all of the cable assemblies 200 have been dispensed from the dispenser 300, the dispenser 300 can be reused by refilling the dispenser 300 with additional cable assemblies 200. The outer surfaces of the housing 302 can include information about the cable assemblies 200 within the housing 302, e.g., logos, the cable type, the connector type, the number of cables in the dispenser 300, and the like. In some embodiments, the housing 302 can be fabricated from, e.g., a plastic material, a glass material, a metal material, and the like. In some embodiments, the housing 302 can be collapsible. In some embodiments, the housing 302 can be translucent. In addition, the dispenser 300 can include a counter 324 on an outer surface of the housing 302 for sensing and indicating the number of cable assemblies 200 remaining in the housing 302. The counter 324 can be reset when the dispenser 300 is refilled with additional cable assemblies 200. The system 100 can therefore be used for effectively and/or efficiently packaging, organizing, identifying, accessing and/or dispensing a variety of cables.

Figure 2:
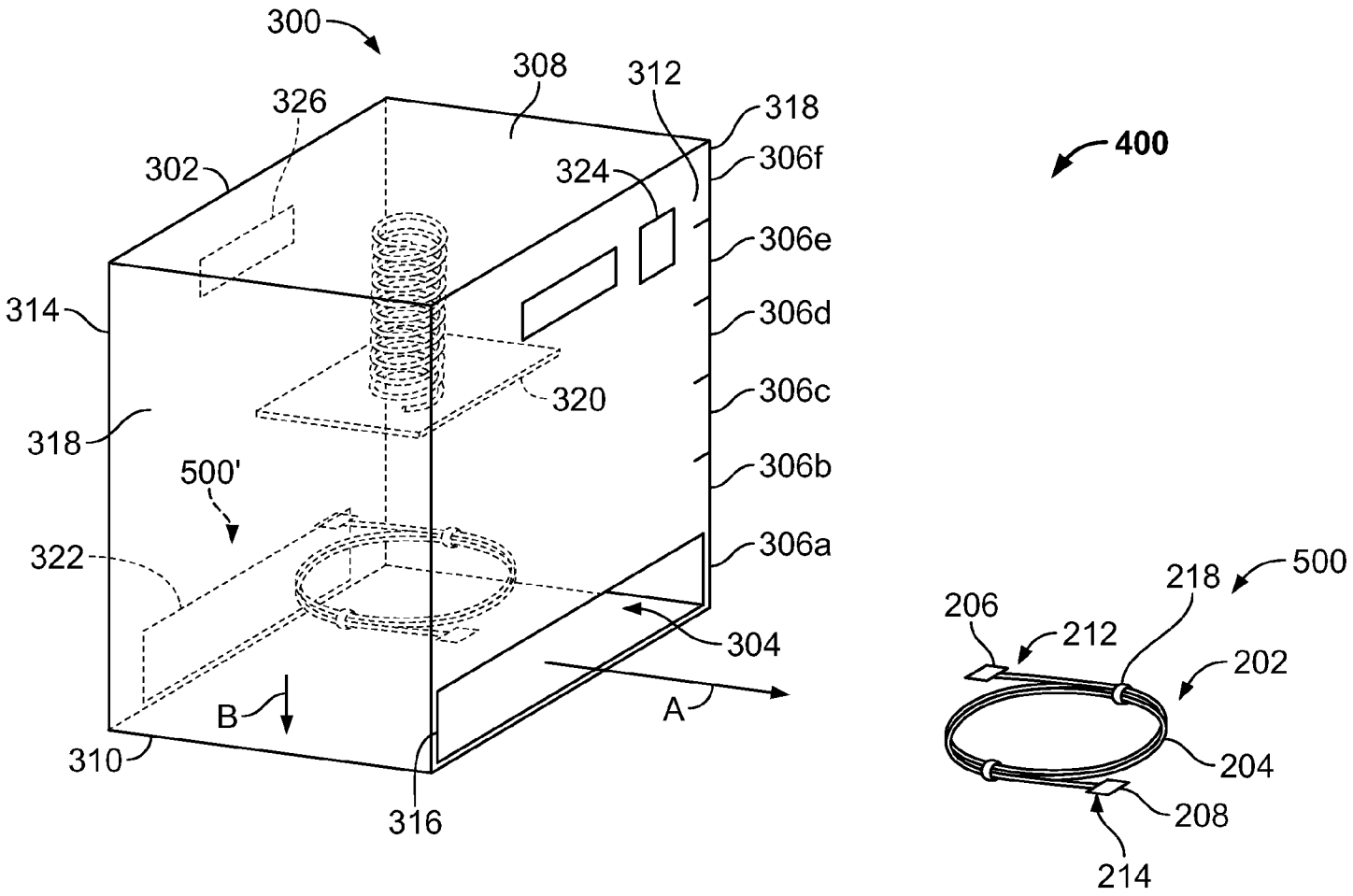
FIG. 2 is a perspective view of an exemplary cable assembly dispensing system, including an exemplary cable assembly and a cable assembly dispenser according to the present disclosure.

Turning now to FIG. 2, a perspective view of an exemplary cable assembly dispensing system 400 (hereinafter "system 400"), e.g., a cable assembly packaging and payout system, is provided that includes an exemplary cable assembly 500 and a dispenser 300. In particular, the dispenser 300 of system 400 can be substantially similar in structure and function to the dispenser 300 of system 100 shown in FIG. 1. The cable assembly 500 of system 400 can be substantially similar to the cable assembly 200 of system 100 shown in FIG. 1, except that the cable assembly 500 does not include a support element 210. The cable assembly 500 of system 400 generally includes at least one cable 202 that includes an elongated cord 204 and can include connectors 206, 208 at the first and second ends 212, 214. In some embodiments, at least one of the first and second ends 212, 214 can define a bare cable end. The cable 202 can be wound or coiled in, e.g., a circular configuration, an oval configuration, and the like, and can be bound by one or more binding elements 218, e.g., a wrapping, a cable tie, adhesive tape, and the like. For example, FIG. 2 illustrates cable 202 wound in a circular configuration and bound by adhesive tape.

Packaging the cable assemblies 500 without the support element 210 can further decrease costs associated with production of the cable assemblies 500 and reduce installation times by necessitating less materials to be removed for installation of the cable 202. For example, once dispensed from the dispenser 300, the cable assembly 500 can be unwound or uncoiled by tearing or breaking the binding element 218. Thus, rather than removing cables 202 from multiple packaging materials, the cable 202 can be ready for installation within a shorter period of time by necessitating a lesser amount of materials to be removed to unwind the cable 202.

Similar to system 100, the cable assemblies 500 of system 400 can be vertically stacked within the housing 302 of the dispenser 300 such that when a cable assembly 500 positioned in the first position 306*a* is dispensed and/or pulled out of the opening 316 in the housing 302 in the direction B, any cable assemblies 500 positioned above the dispensed cable assembly 500 automatically move down one position in the direction B toward the bottom wall 310 and adjacent to the opening 316. For example, the cable assembly 500 was positioned in the first position 306*a* of the housing 302 and was pulled out of the opening 316 in the direction A. The cable assembly 500' was positioned directly above cable assembly 500 in the housing 302. Thus, when cable assembly 500 is pulled out of the housing 302, the cable assembly 500' automatically moves in the direction B from the second position 306*b* to the first position 306*a* adjacent to the opening 316.

In some embodiments, a spring-loaded mechanism 320 can be used to force the cable assembly 500' in the direction B. In some embodiments, the mechanism 320 can be actuated manually by a user with, e.g., a switch. In some embodiments, the cable assembly 500' can be forced in the direction B only by a gravitational force. The repositioning of the cable assemblies 500 located above the dispensed cable assembly 500 advantageously positions the next available cable assembly 500 to be dispensed, thereby decreasing installation times. As discussed above, the dispenser 300 can include a spring-loaded mechanism 322 aligned with the first position 306*a* and the opening 316 to at least partially dispense the cable assembly 500 from the housing 302 when the cable assembly 500 is repositioned into the first position 306*a*. In some embodiments, the dispenser 300 includes a counter 324 on an outer surface of the housing 302 for sensing and indicating the number of cable assemblies 500 remaining in the housing 302. The system 400 can therefore be used for effectively and/or efficiently packaging, organizing, identifying, accessing and/or dispensing a variety of cables.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

What is claimed is:

1. A cable assembly dispenser system, comprising:

at least two cable assemblies, each of the at least two cable assemblies including (i) at least one wound or coiled communication cable that includes an elongated cord that defines a first end and a second end, each communication cable configured to allow connections for communication between electronic devices, and (ii) a support element configured and dimensioned to support the at least one wound or coiled communication cable thereon, each supported wound or coiled communication cable detachable and removable from its respective support element, each detached communication cable configured to be unwound or uncoiled to allow connections for communication between electronic devices via each detached and unwound or uncoiled communication cable; and a housing that includes one or more side walls, a base and a top and that defines an enclosed volume configured and dimensioned to receive the at least two cable assemblies having the wound or coiled communication cables within the enclosed volume, the housing including at least one opening for dispensing each of the at least two cable assemblies having the wound or coiled communication cables, wherein the enclosed volume of the housing is configured and dimensioned to receive the at least two cable assemblies having the wound or coiled communication cables in a vertically stacked configuration;

wherein dispensing a first cable assembly of the at least two cable assemblies having the wound or coiled communication cables from the enclosed volume through the at least one opening automatically repositions, due to gravitational forces, a second cable assembly of the at least two cable assemblies having the wound or coiled communication cables within the enclosed volume so as to be adjacent to the at least one opening; and including a first mechanism for repositioning the second cable assembly of the at least two cable assemblies having the wound or coiled communication cables adjacent to the at least one opening which imparts a force on the second cable assembly in a direction of a position aligned with the at least one opening.

2. The system of claim 1, wherein each of the at least two cable assemblies includes at least one electrical or fiber optic connector mounted with respect to the first end or the second end of the elongated cord.

3. The system of claim 1, wherein each of the at least two cable assemblies includes at least one bare communication cable end at the first or the second end of the elongated cord.

4. The system of claim 1, wherein the support element defines a planar surface.

5. The system of claim 1, wherein the support element defines a stiff surface.

6. The system of claim 1, wherein each of the at least two cable assemblies having the wound or coiled communication cables includes a coupler element for detachably securing the at least one wound or coiled communication cable to the support element.

7. The system of claim 1, wherein the first mechanism automatically repositions the second cable assembly of the at least two cable assemblies having the wound or coiled communication cables adjacent to the at least one opening.

8. The system of claim 1, including a second mechanism for at least partially dispensing the first cable assembly of the at least two cable assemblies having the wound or coiled communication cables from the at least one opening when the first cable assembly is positioned in a position aligned with the at least one opening which imparts a force in a direction of the at least one opening.

9. The system of claim 1, including a counter for indicating a number of cable assemblies having the wound or coiled communication cables remaining in the housing.

10. A method of cable assembly dispensing, comprising:

providing at least two cable assemblies, each of the at least two cable assemblies including (i) at least one wound or coiled communication cable that includes an elongated cord that defines a first end and a second end, each communication cable configured to allow connections for communication between electronic devices, and (ii) a support element configured and dimensioned to support the at least one wound or coiled communication cable thereon, each supported wound or coiled communication cable detachable and removable from its respective support element, each detached communication cable configured to be unwound or uncoiled to allow connections for communication between electronic devices via each detached and unwound or uncoiled communication cable;

providing a housing that includes one or more side walls, a base and a top that define an enclosed volume configured and dimensioned to receive the at least two cable assemblies having the wound or coiled communication cables, the housing including at least one opening for dispensing each of the at least two cable assemblies having the wound or coiled communication cables, positioning the at least two cable assemblies having the wound or coiled communication cables in the enclosed volume of the housing in a vertically stacked configuration;

dispensing a first cable assembly of the at least two cable assemblies having the wound or coiled communication cables from the enclosed volume of the housing through the at least one opening of the housing, automatically repositioning, due to gravitational forces, a second cable assembly of the at least two cable assemblies having the wound or coiled communication cables adjacent to the at least one opening;

detaching and removing the wound or coiled communication cable of the first cable assembly away from its respective support element; and unwinding or uncoiling the detached communication cable of the first cable assembly to allow connections for communication between electronic devices via the detached and unwound or uncoiled communication cable of the first cable assembly;

wherein dispensing the first cable assembly of the at least two cable assemblies having the wound or coiled communication cables from the at least one opening includes imparting a force with a first mechanism on the first cable assembly in a direction of the at least one opening to at least partially dispense the first cable assembly from the at least one opening.

11. The method of claim 10, wherein repositioning the second cable assembly of the at least two cable assemblies having the wound or coiled communication cables adjacent to the at least one opening includes imparting a force with a second mechanism on the second cable assembly in a direction of a position aligned with the at least one opening.

12. A cable assembly dispenser system, comprising:

at least two cable assemblies, each of the at least two cable assemblies including a wound or coiled communication cable that includes an elongated cord that defines a first end and a second end, each communication cable configured to be unwound or uncoiled to allow connections for communication between electronic devices; and a housing that includes one or more side walls, a base and a top that define an enclosed volume configured and dimensioned to receive the at least two cable assemblies having the wound or coiled communication cables, the housing including at least one opening for dispensing each of the at least two cable assemblies having the wound or coiled communication cables, and a counter for indicating a number of cable assemblies having the wound or coiled communication cables remaining in the housing;

wherein the at least two cable assemblies having the wound or coiled communication cables are positioned within the enclosed volume of the housing in a vertically stacked configuration; and wherein dispensing a first cable assembly of the at least two cable assemblies having the wound or coiled communication cables from the enclosed volume of the housing through the at least one opening of the housing automatically repositions, due to gravitational forces, a second cable assembly of the at least two cable assemblies having the wound or coiled communication cables adjacent to the at least one opening.

13. The system of claim 12, wherein each of the at least two cable assemblies having the wound or coiled communication cables includes a detachable binding element for detachably binding the elongated cord.

14. The system of claim 12, including a coupler element for detachably coupling one of the at least two cable assemblies having the wound or coiled communication cables to a support element, the support element being configured and dimensioned to support one of the at least two cable assemblies having the wound or coiled communication cables thereon, the supported wound or coiled communication cable detachable and removable from its respective support element, and the detached communication cable configured to be unwound or uncoiled to allow connections for communication between electronic devices.

* * * * *